US008905380B2

(12) United States Patent
Davis

(10) Patent No.: US 8,905,380 B2
(45) Date of Patent: Dec. 9, 2014

(54) CHAIN DRIVE CONTROL SYSTEM

(75) Inventor: Adam Davis, Leola, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 0 days.

(21) Appl. No.: 13/291,422

(22) Filed: Nov. 8, 2011

(65) Prior Publication Data

US 2013/0112930 A1 May 9, 2013

(51) Int. Cl.

| | |
|---|---|
| ***B66D 1/50*** | (2006.01) |
| ***B66D 1/26*** | (2006.01) |
| ***B66D 1/48*** | (2006.01) |
| ***B66D 1/46*** | (2006.01) |

(52) U.S. Cl.

CPC .. *B66D 1/46* (2013.01); *B66D 1/26* (2013.01); *B66D 1/485* (2013.01)

USPC ..... 254/273; 254/278; 254/292; 254/340

(58) Field of Classification Search

USPC ..... 254/264, 273, 275, 358, 362, 372, 278, 254/290, 292, 340

See application file for complete search history.

(56) References Cited

U.S. PATENT DOCUMENTS

| | | | | |
|---|---|---|---|---|
| 4,392,187 | A | 7/1983 | Bornhorst | |
| 4,710,819 | A | 12/1987 | Brown | |
| 4,947,302 | A | 8/1990 | Callahan | |
| 5,209,560 | A | 5/1993 | Taylor et al. | |
| 5,769,527 | A | 6/1998 | Taylor et al. | |
| 5,920,476 | A | 7/1999 | Hennessey et al. | |
| 6,209,852 | B1 | 4/2001 | George et al. | |
| 6,297,610 | B1 | 10/2001 | Bauer et al. | |
| 6,459,919 | B1 | 10/2002 | Lys et al. | |
| 6,600,289 | B2 | 7/2003 | George et al. | |
| 6,873,355 | B1 | 3/2005 | Thompson et al. | |
| 7,080,824 | B1 | 7/2006 | George et al. | |
| 7,080,825 | B1 | 7/2006 | George et al. | |
| 7,971,856 | B2 | 7/2011 | Kochan | |
| 2006/0095647 | A1 * | 5/2006 | Battaglia et al. | 711/100 |
| 2007/0191966 | A1 | 8/2007 | Fisher et al. | |
| 2009/0015426 | A1 | 1/2009 | Long et al. | |
| 2010/0275476 | A1 * | 11/2010 | Pentland | 40/457 |

FOREIGN PATENT DOCUMENTS

| | | | |
|---|---|---|---|
| WO | 2011079115 | A1 | 6/2011 |
| WO | 2011079122 | A1 | 6/2011 |

OTHER PUBLICATIONS

XLNT Advanced Technologies Manufacturing BV, User Manual, Cyberhoist CH 1000/500/250 EU/US, Jan. 2009, Version 3, 32 pgs.

* cited by examiner

*Primary Examiner* — Emmanuel M Marcelo
*Assistant Examiner* — Angela Caligiuri

(57) ABSTRACT

A control system is provided for one or more chain drives. The control system includes a automation control system or control device in communication with a control board installed on one or more chain drives. The control board can include a microprocessor and a memory device. The memory device stores one or more computer programs or algorithms executable by the microprocessor to generate a plurality of commands to control the operation of a component, e.g., a motor, of the chain drive in response to receiving an operational command from the automation control system or control device.

13 Claims, 4 Drawing Sheets

CHAIN DRIVE CONTROL SYSTEM

BACKGROUND

The application generally relates to the control and operation of a chain drive. The application relates more specifically to a control system to control the operation of one or more chain drives in which the control instructions for the chain drive are generated from the execution of a control algorithm by a microprocessor incorporated in the chain drive.

Chain drives or chain hoists can be used in a variety of different environments, such as a manufacturing plant, a warehouse, or in the entertainment industry. When used in the entertainment industry, chain drives can be used in the assembly and disassembly of stage components and to move objects such as scenery and/or curtains during a performance.

A chain drive or chain hoist can be attached to an overhead beam or other support structure and can be used to raise or lower an object(s) connected to the chain drive. One way to control the operation of the chain drive is by the manual operation of corresponding command buttons on a control device associated with the chain drive. For example, an operator can press an "up" button on the control device to operate the chain drive to raise the object and can press a "down" button on the control device to operate the chain drive to lower the object. However, the control of the chain drive using the control device can be imprecise due to the operator input requirement. For example, the operator may not be able to obtain a desired position for the chain drive because the operator is unable to stop the chain drive at the desired position due to an inability to press a command button at the appropriate time.

Another way to control the operation of a chain drive is to provide control instructions to the chain drive from a remotely located controller. The remotely located controller can be incorporated with a user interface for the system or can be an intermediate controller, sometimes referred to as a stack, located between the user interface and the chain drive. The controller generates and provides the individual instructions to the chain drive, e.g., raise or lower commands, similar to the instructions provided to the chain drive by the control device. In addition, the controller can receive feedback information from the chain drive relating to the operational status of the chain drive. The controller can provide control instructions to multiple chain drives in order to sequence or coordinate the operation of the chain drives. For example, a controller can be used to coordinate the operation of several chain drives to raise or lower a curtain at the same time and speed. One drawback to the centralized control of multiple chain drives with the controller is that as the number of chain drives in a particular system increases, the processing power or capability of the controller and the controller's corresponding communication bandwidth has to likewise increase in order to be able to provide the appropriate control instructions to the chain drives and receive the corresponding feedback from the chain drives. If the controller cannot process the information and instructions fast enough, the chain drive system may not perform as expected and/or safety risks could be introduced that could cause damage or injury to both people and property. In addition, the use of a controller with an individual chain drive for the assembly and disassembly process would be inefficient and expensive.

Therefore, what is needed is a control system for one or more chain drives that enables the control instructions for the chain drive to be generated using a controller incorporated into the chain drive.

SUMMARY

The present application is directed to a chain drive having a motor, a mechanism connected to the motor and a chain. The chain is engaged by the mechanism to move the chain in response to the motor moving the mechanism. The chain drive has a control board. The control board includes a microprocessor and a memory device. The memory device stores a computer algorithm executable by the microprocessor to generate a plurality of commands to control operation of the motor.

The present application is also directed to a system including a control device and a chain drive. The chain drive includes a motor and a control board. The control board includes a microprocessor and a memory device. The memory device stores a computer algorithm executable by the microprocessor to generate a plurality of commands to control operation of the motor in response to receiving a signal from the control device.

The present application is further directed to a system including an automation control system and a plurality of chain drives in communication with the automation control system. Each chain drive of the plurality of chain drives includes a motor and a control board. The control board includes a microprocessor and a memory device. The memory device stores a computer program executable by the microprocessor to generate a plurality of commands to control operation of the motor in response to receiving an operational command from the automation control system.

One advantage of the present application is the distribution of the control processing load among several controllers to reduce the processing power required of any one controller and enable more cost effective controllers to be used.

Another advantage of the present application is reducing or eliminating manual inputs associated with the operation of the chain drive.

Still another advantage of the present application is the ability of a chain drive controller to respond to an action or event occurring at another chain drive without receiving an instruction from a central controller.

Yet another advantage of the present application is the elimination of a central controller to generate control instructions for the chain drives and the corresponding elimination of the long control wires to each of the chain drives required to transmit the generated control instructions from the central controller.

A further advantage of the present application includes the ability to use shorter control wires or cables, that are more easily replaced, for connection to the chain drives.

An additional advantage of the present application includes the ability of one chain drive controller to provide control instructions to another chain drive in the event of a malfunction in that chain drive's controller.

Other features and advantages of the present application will be apparent from the following more detailed description of the preferred embodiment, taken in conjunction with the accompanying drawings which illustrate, by way of example, the principles of the application.

BRIEF DESCRIPTION OF THE DRAWINGS

Wherever possible, the same reference numbers are used throughout the drawings to refer to the same or like parts.

DETAILED DESCRIPTION OF THE EXEMPLARY EMBODIMENTS

Figure 1:
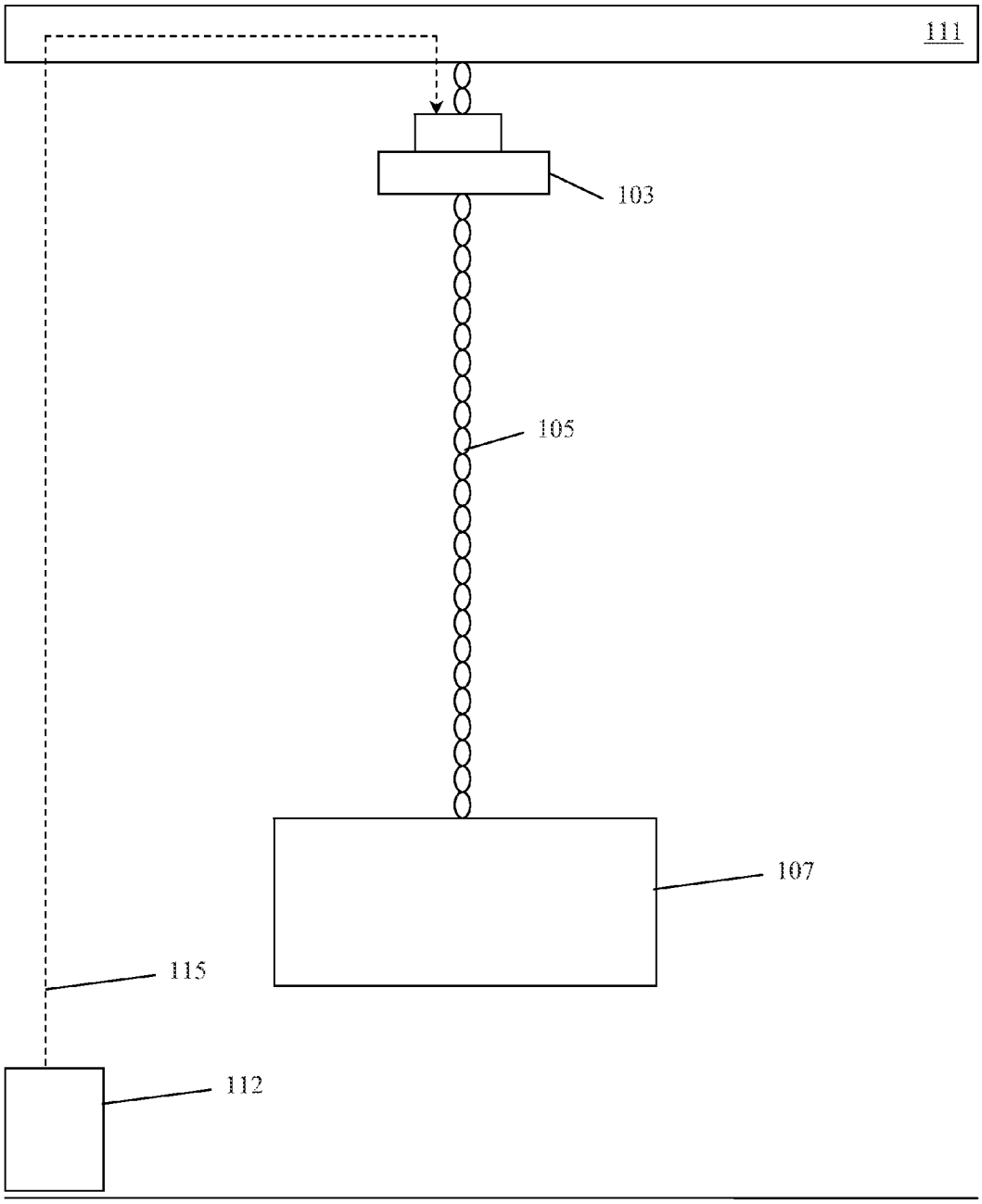
FIG. 1 schematically shows an exemplary embodiment of a chain drive being used to lift an object.

FIG. 1 shows an exemplary embodiment of a chain drive being used to lift an object. A chain drive, chain hoist or chain drive assembly 103 can be mounted to one or more suitable support structures 111, e.g., a truss, a ceiling structure, or a beam, at the location where the chain drive 103 is to be installed. The chain drive assembly 103 can be connected or attached to the support structure 111 by any suitable mechanism or technique. The chain drive 103 can be connected to an object 107 by a chain 105 extending from the chain drive 103. The chain 105 can be connected to the object 107 at a corresponding attachment point(s) by any suitable connection mechanism or arrangement.

The object 107 can be moved, e.g., raised or lowered, by the selective retraction and deploying of the chain 105 by the chain drive 103. The retraction or retracting of the chain 105 refers to the drawing, winding or pulling of the chain 105 into a storage area of the chain drive 103 to shorten or decrease the length of the chain 105 suspended by the chain drive 103. The deployment or deploying, of the chain refers to the releasing, unwinding or pushing of the chain 105 from a storage area of the chain drive 103 to extend or increase the length of the chain 105 suspended by the chain drive 103.

The chain drive or chain drive assembly 103 can include a powered chain drive or other powered device capable of retaining and retracting/deploying the chain 105. In one exemplary embodiment, the chain drive assembly 103 can include a powered chain drive having a motor to drive a mechanism such as a drive gear or set of drive gears which engages the chain 105 to retract or deploy the chain 105. The arrangement of the motor and mechanism or drive gear can include any suitable arrangement known for powered chain drives and may include gearing, clutch assemblies, brakes, belts or other structures useful for translating rotational motion from the motor to rotational motion of the mechanism or drive gear. In one embodiment, rotation of the motor in one direction can deploy the chain 105 and rotation of the motor in the opposite direction can retract the chain 105.

A control device 112 can send signals or operational commands to the chain drive 103 over a control line or wire 115. The control device 112 can be a handheld device that can include one or more control mechanisms, such as pushbutton switches, rotary switches, toggle switches, rocker switches, slide switches or a touch screen interface, that enables an operator to provide basic operational commands or signals to the chain drive 103.

Figure 2:
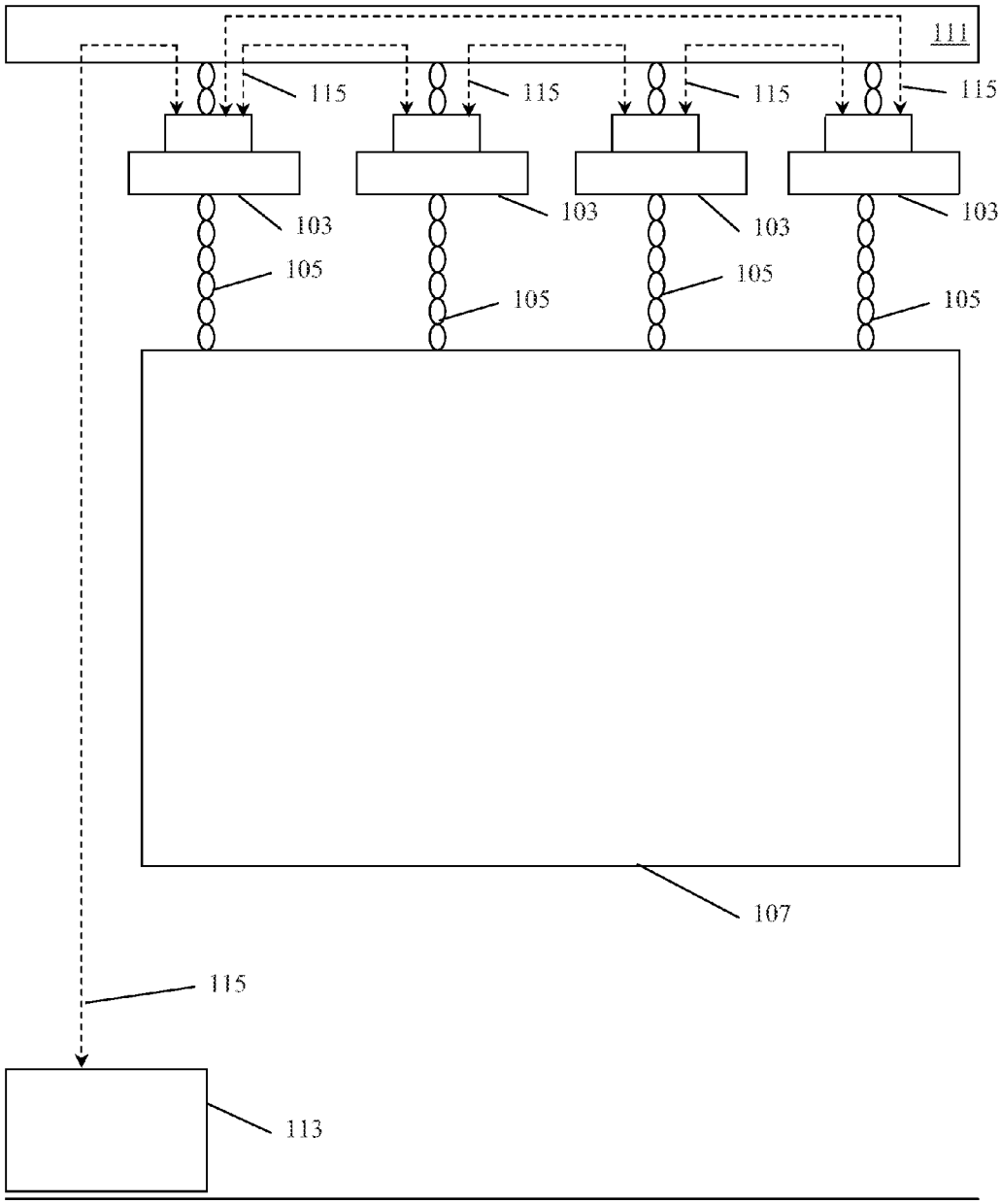
FIG. 2 schematically shows an exemplary embodiment of several chain drives being used to lift an object.

FIG. 2 shows an exemplary embodiment of several chain drives being used to lift an object. The chain drives or chain drive assemblies 103 can be connected to an object 107 by chains 105 extending from each chain drive 103. Each chain 105 can be connected to the object 107 using any suitable connection mechanism or arrangement. The chain drives 103 can be positioned and mounted to enable connections to the ends, corners or intermediate positions of the object 107, as needed in response to the size, shape and weight of the object 107. An automation control system 113 can be in communication with each of the chain drives 103, either directly or indirectly, using control lines 115. The automation control system 113 can provide basic operational commands or signals to each of the chain drives 103 and receive feedback information from each of the chain drives 103 regarding the operation of the chain drives 103.

Figure 3:
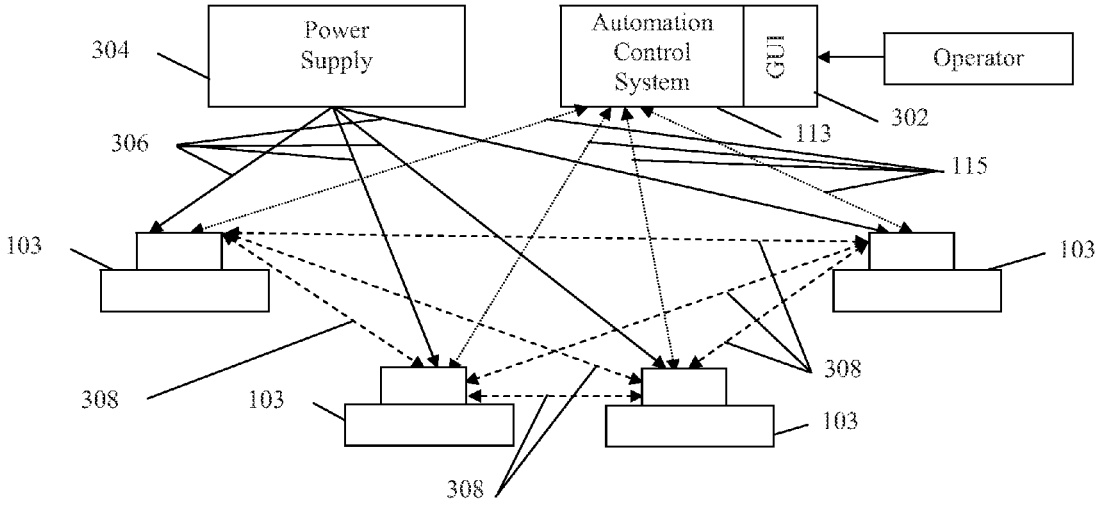
FIG. 3 schematically shows an embodiment of a wiring arrangement for a plurality of chain drives.
Figure 4:
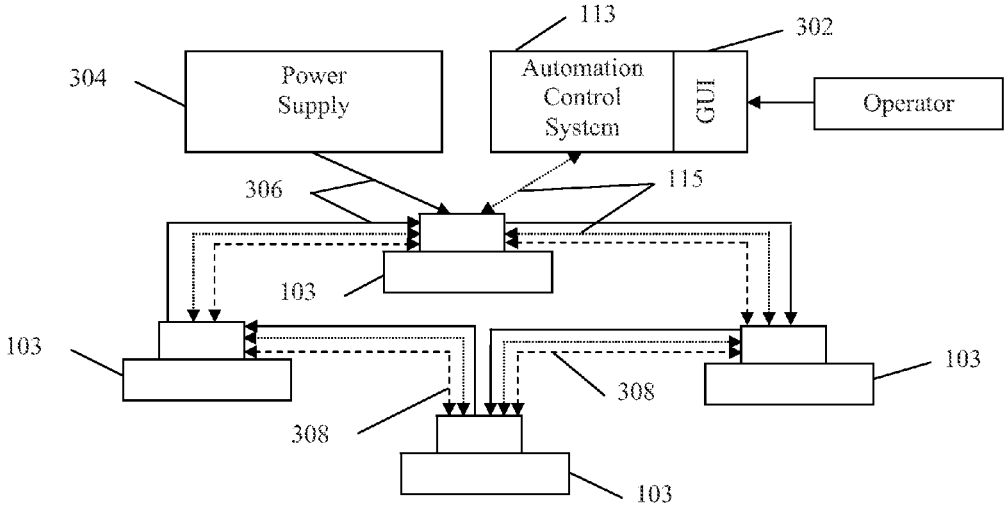
FIG. 4 schematically shows another embodiment of a wiring arrangement for a plurality of chain drives.

Referring now to FIGS. 3 and 4, which schematically show embodiments of the power and control connections for a group of chain drives operating as a system, such as the chain drives in the configuration or embodiment of FIG. 2. Each chain drive assembly 103 can, directly or indirectly, receive control instructions from the automation control system 113 and send information and requests to the automation control system 113 using control lines or wires 115. In addition, each chain drive assembly 103 can, directly or indirectly, receive power from a power supply 304 using power lines or wires 306. Each chain drive assembly 103 is also in communication, i.e., can send and receive information and instructions, with one or more of the other chain drives 103 in the system using communication lines or wires 308. In one exemplary embodiment, control lines 115 and communication lines 308 can be combined into a single line or cable and can use the same wires or conductors to communicate signals, instructions and information. However, in another exemplary embodiment, the communication lines 308 and the control lines 115 may use different types of wires or conductors or the same types of wires or conductors to communicate signals, instructions and information, either in the same cable or in different cables. In still another embodiment, power lines 306 may be combined with one or both control lines 115 and communication lines 308 into a single cable configuration.

The arrangement of control lines 115 may include individual cables or wires connecting each chain drive assembly 103 to the automation control system 113 (as shown in FIG. 3) or may include a daisy chain, ring, mesh or daisy chain loop arrangement. The daisy chain loop or ring arrangement (as shown in FIG. 4) is one wherein the automation control system 113 is connected to a first chain drive 103, that first chain drive is then connected to a second chain drive 103, etc., until the last chain drive 103 in the arrangement is connected back to the first chain drive 103 to complete the ring or loop. By using a ring or daisy chain loop arrangement, a control connection between the automation control system 113 and each chain drive 103 can be maintained in the event that one of the control lines 115 connected between chain drives 103 is damaged or broken. Similarly, the arrangement of power lines 306 may include individual cables or wires connecting each chain drive assembly 103 to the power supply 304 or may include a daisy chain, ring, mesh or daisy chain loop arrangement. For the communication lines 308, each chain drive 103 may be individually wired to every other chain drive 103 or may be wired in a daisy chain, ring, mesh or daisy chain loop arrangement. In one exemplary embodiment, one or both of control lines 115 and communication lines 308 can be replaced by wireless communication techniques for the transmission of signals, instructions and information.

The automation control system 113 can include one or more microprocessors to execute one or more control programs or algorithms associated with control of the chain drives 103 and a graphical user interface (GUI) or human-machine interface (HMI) 302 to enable an operator to interact with the automation control system 113. In one embodiment, the automation control system 113 may also be integrated into or operate as a larger control system that can provide additional control operations or instructions to other components, e.g., lights or winches, that may be used in conjunction with the chain drives 103.

The automation control system 113 can provide basic system-wide instructions applicable to each of the chain drives 103, e.g., a start or execute command or emergency stop (estop) command, using control lines 115. The automation control system 113 can also provide control instructions to individual chain drives 103 based on the executed control program or based on a specific operator input into the GUI 302. In addition, the automation control system 113 can receive information from the chain drives 103 regarding the operation of the chain drives 103 and can provide that information to the operator through the GUI 302.

Figure 5:
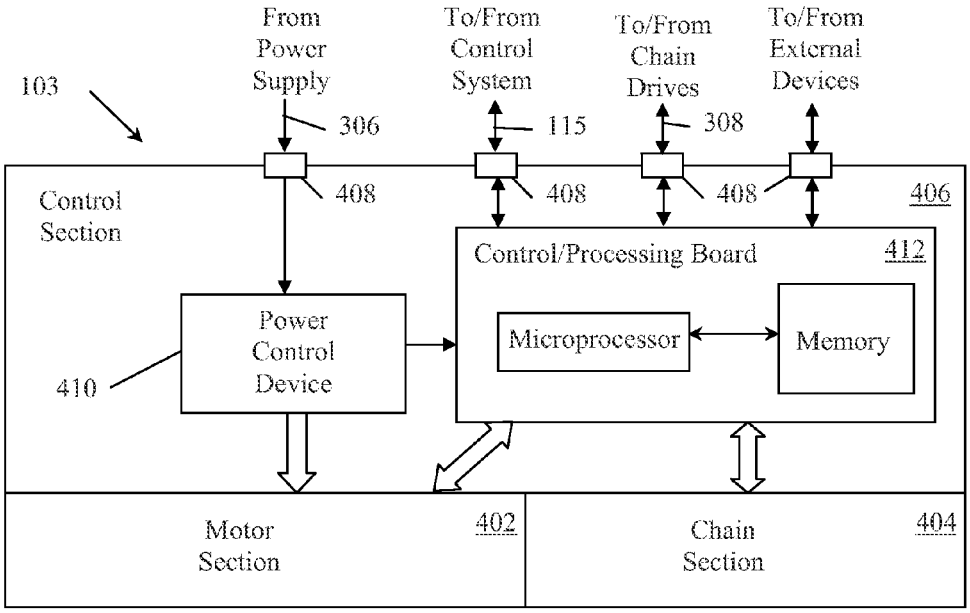
FIG. 5 schematically shows an exemplary embodiment of a chain drive.

As shown in FIG. 5, each chain drive 103 can include a motor section 402, a chain section 404 and a control section 406. The motor section 402 includes the motor and related components and the chain section 404 includes the mechanism or drive gear, chain storage area and related components. The control section 406 can include one or more connection points 408 providing input and/or output connections for one or more of the control lines 115, power lines 306, communication lines 308 and external devices, such as portable memory devices, e.g., memory cards or flash drives.

The control section 406 can include a power control device 410 to receive power from the power lines 306 and provide power to the motor, the control board (and control board components) and any other device in the chain drive 103 that has a power requirement. In one embodiment, the power control device can include one or more transformers. A control/processing board or device 412 is included in the control section 406 and includes one or more microprocessors and one or more memory devices. In one embodiment, the control/processing board 412 can exchange, i.e., send and receive, data, signals, instructions and/or information with the automation control system 113, the other control/processing boards 412 of the other chain drives 103 and/or any connected external devices. In another embodiment, the control/processing board 412 can receive data, signals, instructions and/or information from the control device 112 and/or exchange, i.e., send and receive, data, signals, instructions and/or information with any connected external devices.

In one exemplary embodiment, the microprocessor(s) of the control/processing board 412 can execute one or more control programs or algorithms stored in the memory device(s) associated with that chain drive 103. The control program or algorithm executed by the control/processing board 412 can provide the necessary control instructions to control operation of the components of the chain drive 103. For example, the control/processing board 412 can provide instructions or commands to the motor to deploy or retract the chain 105 and/or to control the speed at which the chain 105 is deployed or retracted and/or to control the length of time or the amount of chain 105 that is deployed or retracted. In one exemplary embodiment, the control/processing board 412 can receive signals, instructions and/or information from the control device 112 and can then generate the appropriate response instructions or commands for the components of the chain drive 103 based on the received input from the control device 112.

In another exemplary embodiment, the control/processing board 412 can receive signals, instructions and/or information from the automation control system 113 and/or the other control/processing boards 412 of the other chain drives 103 and can then generate the appropriate response instructions or commands for the components of the chain drive 103 based on the received input. By having information on the operation of the other chain drives 103, the control/processing board 412 can generate the appropriate instructions or commands for the components of the chain drive 103 to provide for smooth operation of the system.

More specifically, the control programs or algorithms for each control/processing board 412 can include instructions on how the chain drive 103 is to coordinate with the actions of the automation control system 113 or the other chain drives 103 to achieve desired system actions. For example, to raise or lower a curtain or scenery, several of the control/processing boards 412 all have to generate deploy or retract commands substantially simultaneously for a smooth raising or lowering of the curtain or scenery to occur. In addition, in the event of a failure in the motor section 402 or the chain section 404 of one of the chain drives 103, the control/processing boards 412 for the other chain drives can substantially simultaneously execute corresponding safety commands, e.g., emergency stop or e-stop commands.

In an exemplary embodiment, the control section 406 can include one or more sensors to measure operating conditions or parameters in at least one of the motor section 402, the chain section 404 or the control section 406. Some examples of operating conditions or parameters that can be measured can include motor temperature, motor current, available chain, distance of chain deployed or retracted, direction of motor (or drive gear) rotation, speed of motor (or drive gear) rotation, or control/processing board temperature. The sensors can then transmit the measured operational data to the control/processing board 412. The control/processing board 412 can then use this information during the execution of the control program and algorithm to determine and/or generate the appropriate commands. In one embodiment, the control/processing board 412 can also transmit the sensor data to the other control/processing boards 412 and/or the automation control system 113 to be used by the control programs or algorithms of the other control/processing boards 412 and/or the automation control system 113.

In another exemplary embodiment, if one of the control/processing boards 412 should fail, the control of that chain drive 103 can be transferred or distributed to one or more of the other control/processing boards 412. The other control/processing boards 412 can receive the inputs for the failed control/processing board, generate the appropriate control signals using a copy of the control program or algorithm for the failed control/processing board and then transmit the corresponding control instructions back to the chain drive 103 with the failed control/processing board for implementation or execution.

In one exemplary embodiment, a portable memory device can be connected to the control/processing board 412 to provide a control program or algorithm for execution by the microprocessor different from the one stored in the memory device. The new control program or algorithm may be required in response to a new location for the chain drive 103 that requires different commands to be generated corresponding to the new location of the chain drive 103 or in response to a change to the desired actions to be performed by the chain drive 103. The new control program or algorithm can be loaded or stored in the memory device of the control/processing board 412 for execution by the microprocessor or the new control program or algorithm can be executed directly from the portable memory device.

In an exemplary embodiment for the single chain drive 103 configuration/embodiment of FIG. 1, the control/processing board 412 can include a control program(s) associated with the assembly or disassembly of a stage component that can operate in conjunction with commands from the control device 112. For example, the operation of a control mechanism or button on the control device 112 may result in a predetermined action(s) occurring at the chain drive 103, e.g., the retraction or deployment of the chain 105 by a predetermined distance, in accordance with an established assembly or disassembly procedure. In another embodiment, a portable memory device can be inserted in the chain drive 103 with the corresponding control algorithm for the procedure to be performed, e.g., an assembly procedure or a disassembly procedure. In a further embodiment, the portable memory device could include a specific control algorithm associated with a specific procedure for a specific component, e.g., a control algorithm for the assembly of a video screen wall.

In another exemplary embodiment, the control device 112 could include a memory device storing one or more control algorithms relating to one or more specific procedures to be executed and performed by the control device 103. If multiple control algorithms are provided, the operator could select the procedure/control algorithm to be performed on the control device 112 and the control mechanisms or buttons on the control device would then operate in accordance with selected algorithm. If the control device 112 included a touch screen interface, the selection of a particular control algorithm/procedure could result in a different configuration of the touch screen interface presented to the operator. In one embodiment, the control device 112 can include a connection for external devices, such as portable memory devices, e.g., memory cards or flash drives. The portable memory device can include one or more control algorithms corresponding to one or more procedures to be executed and performed by the chain drive 103.

In yet another exemplary embodiment, the control algorithm(s) stored in the chain drive 103 can be executed in response to receiving a particular command or signal from automation control system 113 or control device 112. A command or signal from automation control system 113 could trigger the execution of a control algorithm in the chain drive 103 that would result in several individual actions being taken by the chain drive 103. For example, a sequence of actions taken by the chain drive 103 in response to a signal from the automation control system 113 could be to coordinate with other control/processing boards 412, deploy/retract chain and stop deploying/retracting chain after a predetermined time period. Similarly, the pressing of a button or operation or activation of a control mechanism on the control device 112 could trigger the execution of a control algorithm in the chain drive 103 would result in several individual actions being taken by the chain drive 103. For example, a sequence of actions taken by the chain drive 103 in response to the operation of a control mechanism on the control device 112 could be to deploy/retract the chain and stop deploying/retracting the chain after a predetermined distance of the chain has been deployed/retracted.

The present application contemplates methods, systems and program products on any machine-readable media for accomplishing its operations. The embodiments of the present application may be implemented using an existing computer processor, or by a special purpose computer processor for an appropriate system, or by a hardwired system.

Embodiments within the scope of the present application include program products comprising machine-readable media for carrying or having machine-executable instructions or data structures stored thereon. Machine-readable media can be any available non-transitory media that can be accessed by a general purpose or special purpose computer or other machine with a processor. By way of example, machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communication connection (either hardwired, wireless, or a combination of hardwired or wireless) to a machine, the machine properly views the connection as a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions. Software implementations could be accomplished with standard programming techniques with rule based logic and other logic to accomplish the various connection steps, processing steps, comparison steps and decision steps.

While the exemplary embodiments illustrated in the figures and described herein are presently preferred, it should be understood that these embodiments are offered by way of example only. Other substitutions, modifications, changes and omissions may be made in the design, operating conditions and arrangement of the exemplary embodiments without departing from the scope of the present application. Accordingly, the present application is not limited to a particular embodiment, but extends to various modifications that nevertheless fall within the scope of the appended claims. It should also be understood that the phraseology and terminology employed herein is for the purpose of description only and should not be regarded as limiting.

It is important to note that the construction and arrangement of the present application as shown in the various exemplary embodiments is illustrative only. Only certain features and embodiments of the invention have been shown and described in the application and many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A system comprising:

an automation control system; and a plurality of chain drives, each chain drive comprising:

a motor;

a mechanism connected to the motor;

a chain, the chain being engaged by the mechanism to move the chain in response to the motor moving the mechanism; and a control board, the control board comprising a microprocessor and a memory device, the memory device storing a computer algorithm executable by the microprocessor to generate a plurality of commands to control operation of the motor in response to receiving a signal from the automation control system;

wherein the automation control system is capable of receiving feedback information from one or more of the chain drives regarding the operation of the chain drives;

wherein the automation control system generates the signal based upon coordinated operation of the chain drive with the at least one other chain drive to achieve desired system actions; and wherein the signal generated by the automation control system is based, at least in part, upon feedback information from one or more of the chain drives.

2. The system of claim 1 wherein the automation control system comprises at least one of a switch or a touch screen interface.

3. The system of claim 1 wherein the computer algorithm executed by the microprocessor results in the operation of the motor for a predetermined amount of time.

4. A system comprising:

an automation control system; and a plurality of chain drives in communication with the automation control system, each chain drive of the plurality of chain drives comprising:

a motor;

a mechanism connected to the motor;

a chain, the chain being engaged by the mechanism to move the chain in response to the motor moving the mechanism; and a control board, the control board comprising microprocessor and a memory device, the memory device storing a computer program executable by the microprocessor to generate a plurality of commands to control operation of the motor in response to receiving a signal from the automation control system;

wherein the control board also receives feedback information from the plurality of chain drives regarding operation of the plurality of chain drives; and wherein the control board coordinates the action of the chain drive with the plurality of chain drives, based at least in part upon the feedback information from the plurality of chain drives, to achieve desired system actions.

5. The system of claim 4 wherein the automation control system comprises a second computer program executable by a second microprocessor to generate the operational commands for the plurality of chain drives.

6. The system of claim 5 wherein each chain drive of the plurality of chain drives comprises a connection point in communication with the automation control system to receive the generated operational commands from the automation control system.

7. The system of claim 4 wherein the plurality of chain drives are connected in a daisy chain loop arrangement to communicate with the automation control system.

8. The system of claim 4 wherein each chain drive of the plurality of chain drives comprises a connection point in communication with at least one other chain drive of the plurality of chain drives to receive data from the at least one other chain drive of the plurality of chain drives.

9. The system of claim 4 wherein each chain drive of the plurality of chain drives comprises a connection point to receive a portable memory device.

10. The system of claim 4 wherein a first operational command from the automation control system results in each microprocessor of the plurality of chain drives executing the computer algorithm to rotate the motor in a first direction and a second operational command from the automation control system results in each microprocessor of the plurality of chain drives executing the computer algorithm to rotate the motor in a second direction opposite the first direction.

11. The system of claim 4 wherein the motor of at least one chain drive is controllable by one or more of the control boards of a second chain drive other than the at least one chain drive.

12. The system of claim 4 wherein each chain drive of the plurality of chain drives is individually wired to every other chain drive of the plurality of chain drives.

13. The system of claim 4 wherein the signal from the automation control system is communicated using control lines, and the feedback information from the plurality of chain drives is communicated using communication lines.

* * * * *